United States Patent [19]

Holcomb

[11] Patent Number: 4,858,426

[45] Date of Patent: Aug. 22, 1989

[54] SECONDARY OIL SYSTEM FOR GAS TURBINE ENGINE

[75] Inventor: Warren N. Holcomb, Indianapolis, Ind.

[73] Assignee: General Motors Corporation, Detroit, Mich.

[21] Appl. No.: 222,994

[22] Filed: Jul. 21, 1988

[51] Int. Cl.[4] ..... F02C 7/06

[52] U.S. Cl. ..... 60/39.08; 184/6.11

[58] Field of Search ..... 60/39.08, 39.091, 39.83; 184/6.11, 6.4, 65; 384/473

[56] References Cited

U.S. PATENT DOCUMENTS

| | | | |
|---|---|---|---|
| 3,147,821 | 9/1964 | Eggenberger | 184/65 |
| 3,779,345 | 12/1973 | Barnes et al. | 184/6.4 |
| 4,153,141 | 5/1979 | Methlie | 60/39.08 |
| 4,284,174 | 8/1981 | Salvana et al. | 60/39.08 |
| 4,373,421 | 2/1983 | Camboulives et al. | 60/39.08 |
| 4,390,082 | 6/1983 | Swearingen | 60/39.08 |
| 4,511,016 | 4/1985 | Döëll | 60/39.08 |
| 4,564,084 | 1/1986 | Heckel | 60/39.08 |
| 4,717,000 | 1/1988 | Waddington et al. | 184/61 |
| 4,741,155 | 1/1988 | McCarty | 60/39.02 |

*Primary Examiner*—Donald E. Stout
*Attorney, Agent, or Firm*—Saul Schwartz

[57] ABSTRACT

A secondary oil system for a flight propulsion gas turbine engine having vertical and horizontal flight modes includes an annular reservoir tank in a bearing sump of the engine around a rotor shaft of the engine, a pipe connected to the primary oil system of the engine extending through the reservoir tank and conducting a primary oil flow to a bearing in the sump, an inlet orifice at the top of the reservoir tank in each of the horizontal and vertical flight modes between the pipe and the reservoir tank for conducting a part of the primary oil flow to the reservoir tank, a discharge orifice at the bottom of the reservoir tank in each of the vertical and horizontal flight modes having a flow are limiting a gravity induced secondary oil flow from the reservoir tank to a secondary oil flow rate substantially less than the primary oil flow rate, and a passage conducting the gravity induced secondary oil flow to the bearing in the sump. The secondary oil flow persists after primary oil flow stops until the reservoir tank completely drains.

2 Claims, 1 Drawing Sheet

SECONDARY OIL SYSTEM FOR GAS TURBINE ENGINE

This invention was made in the course of work under a contract or subcontract of the United States Department of Defense.

FIELD OF THE INVENTION

This invention relates to secondary oil systems in flight propulsion gas turbine engine for lubricating rotating elements of the engine after primary oil flow stops.

BACKGROUND OF THE INVENTION

To the end of providing limited flight capability after primary oil flow to rotating elements of a flight propulsion gas turbine engine is interrupted, a proposed secondary oil system has an annular reservoir around a bearing sump of the engine which reservoir is filled with oil from the primary oil system of the engine. A primary lubricant nozzle for a bearing in the sump forms a standpipe in the reservoir and conducts a primary oil flow to the bearing when the level of oil in the reservoir exceeds the level of the intake end of the nozzle. A secondary lubricant nozzle at the top of a separate annular chamber of the reservoir has a tip exposed to a low pressure zone created by a relatively fast moving stream of compressor discharge air. Oil enters the separate chamber through an orifice at the bottom of the reservoir. A secondary oil flow from the separate chamber is induced by the low pressure zone concurrently with primary oil flow and persists after primary flow stops until the reservoir is exhausted. A new and improved secondary oil system according to this invention provides a simple and economical arrangement of elements which, in association with an in-sump reservoir tank, achieves a continuous, gravity induced secondary oil flow which persists after primary oil flow stops.

SUMMARY OF THE INVENTION

This invention is a new and improved secondary oil system for a gas turbine engine of the type having a stationary annular reservoir tank adjacent a bearing in a bearing sump of the engine. The secondary oil system according to this invention is particularly suited for a flight propulsion gas turbine engine having a helicopter-like vertical flight mode and a fixed-wing-like horizontal flight mode. In the vertical flight mode, a main rotor axis of the engine is vertical and in the horizontal flight mode the main rotor axis is horizontal. The secondary oil system according to this invention includes a fill pipe of the primary oil system traversing a portion of the interior of the reservoir tank, an inlet orifice in the fill pipe within and generally at the top of the reservoir tank for filling the tank with a portion of the primary oil flow, a vent from the reservoir tank to the sump to assure pressure equalization between the sump and the tank, and an oil discharge orifice at a location on the reservoir tank corresponding to the bottom of the tank in both horizontal and vertical flight modes of the engine. The discharge orifice is connected to the sump near the bearing so that gravity induces a continuous secondary oil flow through the discharge orifice. The flow area of the discharge orifice is calculated to limit secondary oil flow to a small fraction of the primary oil flow to the bearing so that the lubrication supplement provided by the secondary oil flow is minimal during normal engine operation but sufficient to sustain the bearing for a secondary duration after the primary oil flow stops.

DESCRIPTION OF A PREFERRED EMBODIMENT

Figure 1:
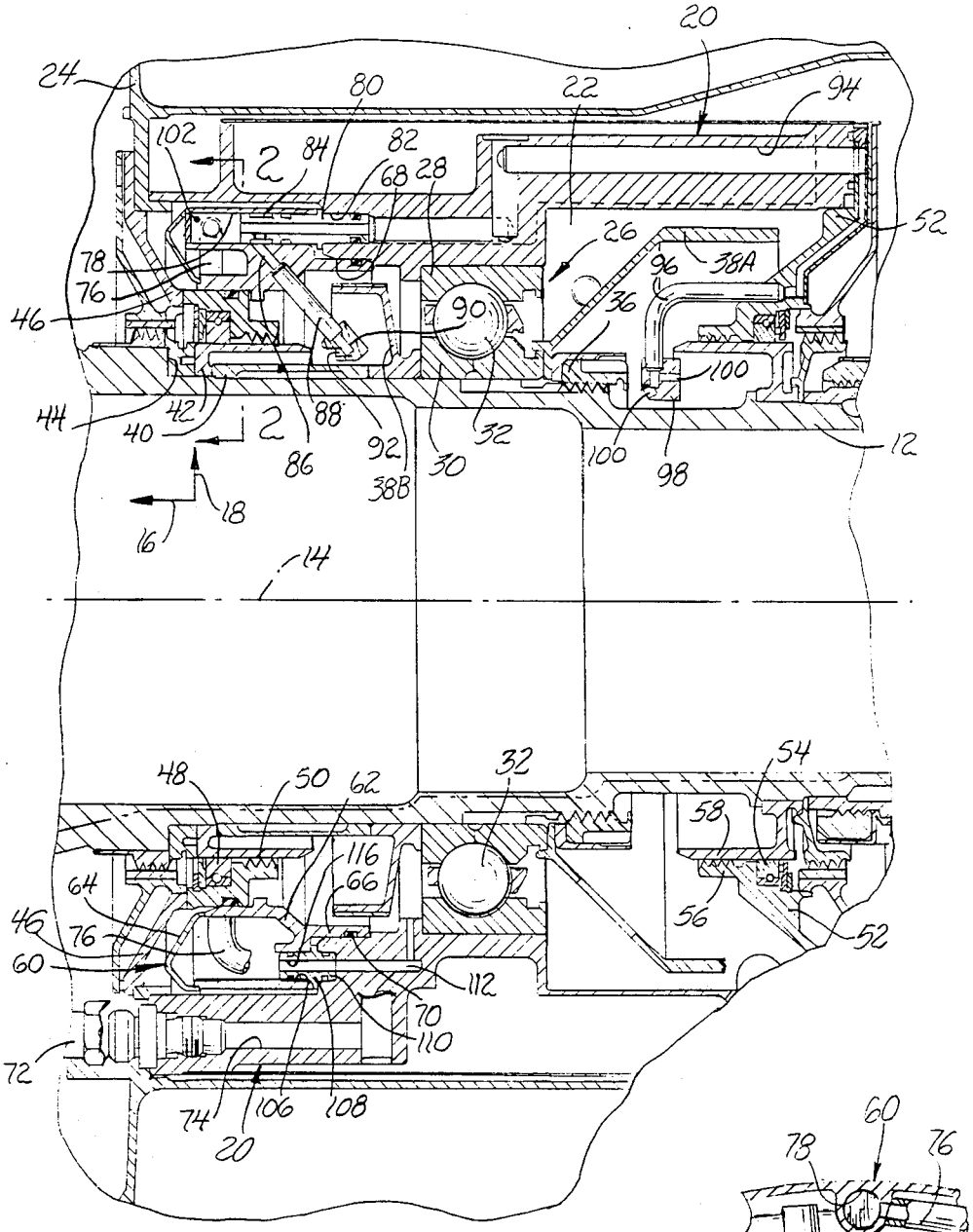
FIG. 1 is a fragmentary elevational view of a gas turbine engine showing a bearing sump of the engine and a bearing in the sump lubricated by a secondary oil system according to this invention.

A fragmentarily illustrated flight propulsion gas turbine engine includes a tubular rotor shaft 12 aligned on a rotor shaft axis 14 of the engine. The engine may be a flight propulsion gas turbine engine having a horizontal flight mode corresponding to conventional fixed wing aircraft propulsion and a vertical flight mode corresponding to vertical takeoff and landing and other helicopter-like flight maneuvers. In the horizontal flight mode, the axis 14 is parallel to the horizontal coordinate axis 16 of the orientation diagram in the drawing figure. In the horizontal flight mode, the front of the engine faces forward and to the left as indicated by the arrow on horizontal coordinate axis 16. In the vertical flight mode, the axis 14 is parallel to the vertical coordinate axis 18 of the orientation diagram. In the vertical flight mode, the front of the engine faces up as indicated by the arrow on vertical coordinate axis 18.

The rotor shaft 12 cooperates with a generally annular housing 20 of the gas turbine engine in defining a bearing sump 22 of the engine. The housing 10 is a rigid internal appendage of the casing of the engine, not shown, and may be attached to the latter through a fragmentarily illustrated internal annular web 24 connected to the casing. A bearing 26 is disposed between the housing 20 and the tubular rotor shaft 12 and cooperates with other bearings of the engine, not shown, in supporting the rotor shaft 12 on the casing of the engine for rotation about the axis 14. The bearing has an outer race 28 supported on the housing, an inner race 30 on the rotor shaft 12, and a plurality of bearing balls 32 between the races. The inner race is retained on the rotor shaft 12 by a nut 36 threaded on the shaft which captures the inner race 30, a pair of oil scavenge impellers 38A–B, a spacer 40 and a seal runner 42 against a shoulder 44 of the shaft.

Toward the front of the engine, the bearing sump 22 is closed by an annular partition 46 attached to the web 24. The partition 46 carries a carbon seal 48 and a labyrinth seal 50 each of which cooperates with the seal runner 42 to define front seals for the sump 22. Toward the aft end of the engine, the sump 22 is closed by an annular partition 52 attached to the housing 20. The partition 52 carries a carbon seal 54 and a labyrinth seal 56 each of which cooperates with a seal runner 58 on the rotor shaft 12 to define aft or rear seals for the sump 22. To prevent internal contamination of the engine around the sump, a controlled pressure differential is maintained between the sump and its surrounding environment which differential assures gas leakage only into the sump.

An annular reservoir tank 60 is disposed in the sump 22 adjacent the bearing 26. The tank 60 has a U-shaped, in cross section, main body portion 62 the open end of which is closed by a wall 64. An annular pilot flange 66 of the main body portion 62 is closely received in a pilot diameter 68 of the housing 20 whereby the reservoir tank is supported on the housing around the rotor shaft 12. The interface between the pilot flange 66 and the pilot diameter 68 is sealed by a seal ring 70 in an appropriate groove in the pilot flange.

The primary oil system of the engine, i.e. the system which normally provides oil under pressure to lubricate moving parts of the engine such as the bearing 26, includes a first pipe 72 connected to a passage 74 in the housing 20. The passage 74 is similarly connected to a second pipe 76 which traverses a portion of the interior of the reservoir tank 60. The second pipe 76 enters the tank near the bottom thereof through a conventional sealed connection, not shown, through the main body portion 62. At the top of the tank 60, the second pipe 76 is rigidly attached to the main body portion 60 and opens into a bore 78 in the latter facing the housing 20.

The primary oil system further includes a first jumper tube 80 disposed in the bore 78 and in an aligned bore 82 in the housing 20. An outside groove 84 in the jumper tube 80 is connected to the center passage thereof and, through a passage 86 in the main body portion 62 and a tube 88, to a nozzle 90. The nozzle 90 has an orifice 92 for directing part of the primary oil flow as a jet of oil at the seal runner 42. The bore 82 defines part of a passage system 94 in the housing 20 through which the primary oil flow is conducted to another tube 96 and to a second nozzle 98. The second nozzle 98 has a plurality of orifices 100 for directing part of the primary oil flow as jets of oil at the bearing 26 through grooves in the rotor shaft 12. The second nozzle 98 also directs part of the primary oil flow toward the seal runner 58.

Figure 2:
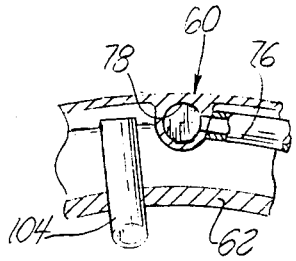
FIG. 2 is a fragmentary sectional view taken generally along the plane indicated by lines 2—2 in FIG. 1 and showing a portion of only the reservoir tank of the secondary oil system according to this invention.

A secondary oil system according to this invention includes an inlet orifice 102 in the main body portion 62 of the reservoir tank 60 generally at the left extremity of the bore 78. The inlet orifice 102 is located near the top of the reservoir tank 60 in both the horizontal and vertical flight modes of the gas turbine engine. The secondary oil system further includes an overflow and vent in the form of a pipe 104, FIG. 2, on the body portion 62 having one end in the reservoir tank 60 generally at the elevation of the inlet orifice 102. The pipe 104 extends through the main body portion into the sump 22 whereby the pressure in the tank is always the same as the pressure in the sump.

The main body portion 62 has a bore 106 therein facing the housing 20 at the bottom of the reservoir tank 60. A second jumper tube 108 is disposed in the bore 106 and in a counterbore 110 at the end of a secondary internal passage 112 in the housing 20. The second jumper tube 108 has a passage 116 therethrough which defines a discharge orifice of the secondary oil system through which gravity induced secondary oil flow is conducted from the reservoir tank into the secondary passage 112. The discharge orifice is located at the bottom of the reservoir tank in both the horizontal and vertical flight modes of the gas turbine engine. The secondary passage 112 terminates at a location on the housing 20 near the outer race 28 of the bearing 26.

The secondary oil system operates in conjunction with the primary oil system as follows. Upon engine start-up, with the engine in the vertical flight mode for helicopter-like takeoff, the primary oil flow quickly fills the pipes 72 and 76, the bore 78 and the passage system 94 whereby the bearing 26 and seal runners 42 and 58 are adequately lubricated and cooled. Concurrently, part of the primary oil flow is conducted into the reservoir tank through the inlet orifice 102 at an intermediate flow rate less than the primary flow rate. The area of the discharge orifice defined by the passage 116 in the second jumper tube 108 limits secondary oil flow out of the reservoir tank to a small fraction of the primary oil flow. Accordingly, the reservoir tank fills relatively rapidly with oil from the primary oil system until the level of the overflow and vent pipe 104 is achieved.

Because the discharge orifice is at the bottom of the tank, secondary oil flow commences substantially at the onset of primary oil flow and, during normal engine operation, supplements the primary oil flow. Because the secondary oil flow is only a small fraction of the primary oil flow, however, the supplementary effect thereof is minimal during normal engine operation.

After a vertical takeoff, the gas turbine engine transitions to the horizontal flight mode. Gravity induced secondary oil flow continues in the horizontal flight mode because the discharge orifice defined by the passage 116 is still located at the bottom of the reservoir tank and the overflow and vent pipe 104 is still at the top of the tank.

If, during either vertical or horizontal flight mode operation of the gas turbine engine, primary oil flow stops, residual oil in the primary oil system may provide only momentary continued lubrication. Gravity induced secondary oil flow persists, however, because the discharge orifice defined by passage 116 is at the bottom of the reservoir tank in either flight mode and because the overflow and vent pipe 104 equalizes the pressures in the sump 22 and in the reservoir tank 60. The secondary oil flow rate, while being only a small fraction of the primary oil flow rate to the bearing 26, is sufficient for the more limited objective of sustaining the bearing during a secondary duration after primary oil flow stops. The secondary duration is the time required for the secondary oil flow rate to drain the reservoir tank and affords an opportunity for the aircraft to be landed in the vertical flight mode regardless of whether primary oil flow stopped in the vertical flight mode or the horizontal flight mode.

The embodiments of the invention in which an exclusive property or privilege is claimed are defined as follows:

1. In a gas turbine engine for flight propulsion in a selected one of a horizontal flight mode and a vertical flight mode, said gas turbine engine having a rotor shaft on an axis of said engine oriented horizontally in said horizontal flight mode and vertically in said vertical flight mode, a generally annular housing of said engine surrounding said rotor shaft, seal means at opposite longitudinal ends of said housing engaging said rotor shaft and defining therebetween an annular sump around said rotor shaft, a bearing in said sump including an inner race on said rotor shaft and an outer race on said housing and a plurality of anti-friction elements between said inner and said outer races, a primary oil system including a pipe conducting a primary oil flow at a primary oil flow rate to a plurality of nozzles in said sump wherein said primary oil flow cools and lubricates said bearing, and an annular reservoir tank disposed in said sump and attached to said housing, the improvement comprising:

a vent and overflow disposed at the top of said reservoir tank in each of said horizontal and said vertical flight modes of said engine and connected to said sump whereby the pressure in said reservoir tank is always equal to the pressure in said sump, means defining an inlet orifice between said pipe and said reservoir tank at the top of said reservoir tank in each of said horizontal and said vertical flight modes of said engine whereby a part of said primary oil flow is conducted into said reservoir tank, means defining a discharge orifice in said reservoir tank at the bottom thereof in each of said horizontal and said vertical flight modes of said engine whereby gravity induces a continuous secondary oil flow from said reservoir tank at a secondary flow rate substantially less than said primary oil flow rate in each of said horizontal and said vertical flight modes of said engine, and means defining a passage between said discharge orifice and said sump conducting said gravity induced secondary oil flow from said reservoir tank to said bearing.

2. In a gas turbine engine for flight propulsion in a selected one of a horizontal flight mode and a vertical flight mode, said gas turbine engine having a rotor shaft on an axis of said engine oriented horizontally in said horizontal flight mode and vertically in said vertical flight mode, a generally annular housing of said engine surrounding said rotor shaft, seal means at opposite longitudinal ends of said housing engaging said rotor shaft and defining therebetween an annular sump around said rotor shaft, a bearing in said sump including an inner race on said rotor shaft and an outer race on said housing and a plurality of anti-friction elements between said inner and said outer races, a primary oil system including a passage in said housing connected to a supply of oil and a passage system in said housing connected to a plurality of nozzles in said sump operative to discharge jets of oil at a primary oil flow rate for cooling and lubricating said bearing in said sump, and an annular reservoir tank disposed in said sump and attached to said housing, the improvement comprising:

an overflow and vent disposed at the top of said reservoir tank in each of said horizontal and said vertical flight modes of said engine and connected to said sump whereby the pressure in said reservoir tank is always equal to the pressure in said sump, means defining an intermediate pipe in said reservoir tank having one end connected to said passage in said housing and the other end connected to said passage system in said housing whereby said intermediate pipe conducts said primary oil flow from said passage to said passage system, means defining an inlet orifice in said intermediate pipe located generally at the top of said reservoir tank in each one of said horizontal and said vertical flight modes of said engine whereby a part of said primary oil flow is conducted into said reservoir tank, means defining a discharge orifice in said reservoir tank at the bottom thereof in each of said horizontal and said vertical flight modes of said engine whereby gravity induces a continuous secondary oil flow from said reservoir tank at a secondary flow rate substantially less than said primary oil flow rate in each of said horizontal and vertical flight modes of said engine, and means defining a passage in said housing between said discharge orifice and said sump conducting said gravity induced secondary oil flow from said reservoir tank to said bearing.

* * * * *